US006062000A

United States Patent [19]

Focke et al.

[11] Patent Number: 6,062,000

[45] Date of Patent: May 16, 2000

[54] METHOD FOR THE OPERATION OF PACKAGING MACHINES AND PACKAGING MACHINE

[75] Inventors: Heinz Focke, Verden; Hermann Mahlmann, Luttum; Fred Philipowsky, Berlin, all of Germany

[73] Assignee: Focke & Co., (GmbH & Co.), Verden, Germany

[21] Appl. No.: 08/988,188

[22] Filed: Dec. 10, 1997

[30] Foreign Application Priority Data

Dec. 16, 1996 [DE] Germany ..... 196 52 210

[51] Int. Cl.[7] ..... B65B 11/00

[52] U.S. Cl. ..... 53/466; 53/228; 53/234

[58] Field of Search ..... 53/52, 56, 55, 53/466, 234, 228, 225

[56] References Cited

U.S. PATENT DOCUMENTS

| | | | |
|---|---|---|---|
| 3,771,279 | 11/1973 | Seragnoli | 53/56 |
| 3,805,477 | 4/1974 | Kruse et al. | 53/55 |
| 3,956,870 | 5/1976 | Kruse et al. | 53/55 |
| 4,294,060 | 10/1981 | Naylor et al. | 53/234 |
| 4,300,329 | 11/1981 | Naylor et al. | 53/234 |
| 5,544,467 | 8/1996 | Focke | 53/234 |
| 5,590,513 | 1/1997 | Belvederi | 53/234 |

FOREIGN PATENT DOCUMENTS

| | | |
|---|---|---|
| 365812 | 5/1990 | European Pat. Off. . |
| 2115505 | 12/1972 | Germany . |
| 2651275 | 6/1977 | Germany . |
| 2650684 | 5/1978 | Germany . |
| 2900615 | 7/1979 | Germany . |
| 3028946 | 2/1981 | Germany . |
| 3316152 | 12/1983 | Germany . |
| 3347368 | 8/1984 | Germany . |
| 3432932 | 3/1985 | Germany . |
| 3734227 | 5/1988 | Germany . |
| 3800432 | 7/1989 | Germany . |
| 3827432 | 2/1990 | Germany . |
| 4216824 | 12/1992 | Germany . |
| 2242665 | 10/1991 | United Kingdom . |
| 2256417 | 12/1992 | United Kingdom . |

*Primary Examiner*—Eugene L. Kim
*Attorney, Agent, or Firm*—Sughrue, Mion, Zinn, Macpeak & Seas, PLLC

[57] ABSTRACT

Method for the operation of packaging machines and packaging machine. In packaging machines for the manufacture of cigarette packs (10) in particular, interruptions in operation are often unavoidable, in order to change the type of pack, but also, for example, on account of the end of a workshift. In the case of interruptions in operation of this kind, the packaging machine is emptied. For this purpose, members and assemblies are coordinated with one another and controlled in such a way that, after the operating phase "emptying" has been initiated, a last pack content, in particular a cigarette group (11) is identified and is transferred completely through the packaging machine. After this cigarette group (11) has passed through individual members, the latter are switched off, in particular a tin foil assembly (20), a paper assembly (23) and a revenue-seal appliance (29) in the region of a drying turret (26). When the packaging machine is restarted, a similar procedure is adopted as regards switching on the assemblies again.

7 Claims, 7 Drawing Sheets

METHOD FOR THE OPERATION OF PACKAGING MACHINES AND PACKAGING MACHINE

BACKGROUND OF THE INVENTION

The invention relates to a method for the operation of packaging machines, in particular for the manufacture of cigarette packs, with at least one folding assembly, for example, a folding turret, or a store for packaging products, for example a cigarette magazine, with conveying members for the packaging product, for example a pocket chain for cigarette groups, with conveying members for packaging material, for example blank assemblies, and with conveying members for completely or partially finished packs, for example a discharge conveyor. The invention relates furthermore to a packaging machine, in particular for the manufacture of cigarette packs.

Packaging machines for the manufacture of cigarette packs, for example of the soft-cup type, have a complex design. Interruptions in operation, for example because of the end of the workshift, due to a change of format of the packs or owing to a change of the (cigarette) brand, therefore present problems. The reason for this is that there is always a large quantity of packaging product (cigarettes) and packaging material inside the packaging machine.

SUMMARY OF THE INVENTION

The object on which the invention is based is to propose measures which make it easier to operate packaging machines in the event of interruptions in operation.

To achieve this object, the method of the invention is characterized in that, in order to empty the packaging machine, the assemblies and members involved are coordinated with one another in terms of the work cycles, in such a way that, when the operating state "emptying of the packaging machine" is initiated, preferably at a reduced working speed or number of cycles, a last unit of the pack content, in particular a cigarette group, is identified and the assemblies and members involved are controlled according to the passage through the packaging machine, in such a way that each assembly or member is switched off according to the packaging progress, after the last unit of the pack content, if appropriate together with blanks, has passed the relevant assembly or member.

According to the invention, therefore, the packaging machine is set up so that, in the event of an interruption in operation for the reasons mentioned, the operation of the packaging machine is continued until a "last" packaging unit has passed through all the assemblies and members, that is to say the entire packaging process. During the passage of this last unit, in particular a cigarette group, the assemblies and members involved are stopped or halted in terms of their functioning when the pack content has passed the relevant assembly or member.

In the production of cigarette packs, the content, namely a cigarette group, is formed in the region of a magazine by pushing the cigarette group out of the cigarette magazine. In order to empty a packaging machine of this type for cigarettes, after the corresponding operating state has been initiated the slide for pushing the cigarette groups out of the cigarette magazine is stopped first. This is followed by assemblies and members, such as a pocket chain for the cigarette groups, blank assemblies for transferring inner blanks and paper blanks (for soft-cup packs) on to a folding turret, a carry-over turret and a subsequent drying turret for receiving finished cigarette packs in elongate drying shafts.

Expediently, the procedure is such that, after the operating stage "emptying" is initiated, the process described is actually initiated when the moveable members of the packaging machine are in a specific position. If the positions of moveable members are defined on the basis of a movement cycle of 360° per work cycle, the process of emptying in the region of the cigarette magazine may be initiated, for example, at 20°.

According to the invention, members for halting the slides for the cigarette magazine in an exact position are designed in a particular way. Furthermore, the drying turret is a particular feature, in order to ensure that all the cigarette packs located in the drying shafts are pushed out properly. For this purpose, the drying turret is driven intermittently during the final phase of emptying.

When the packaging machine is put into operation after emptying, the commencement of operation of the assemblies and members proceeds in a similar way in reverse.

Further particulars of the method and of the packaging machine are explained in more detail below with reference to the exemplary embodiment of a packaging machine illustrated in the drawing in which:

DESCRIPTION OF A PREFERRED EMBODIMENT

Figure 1:
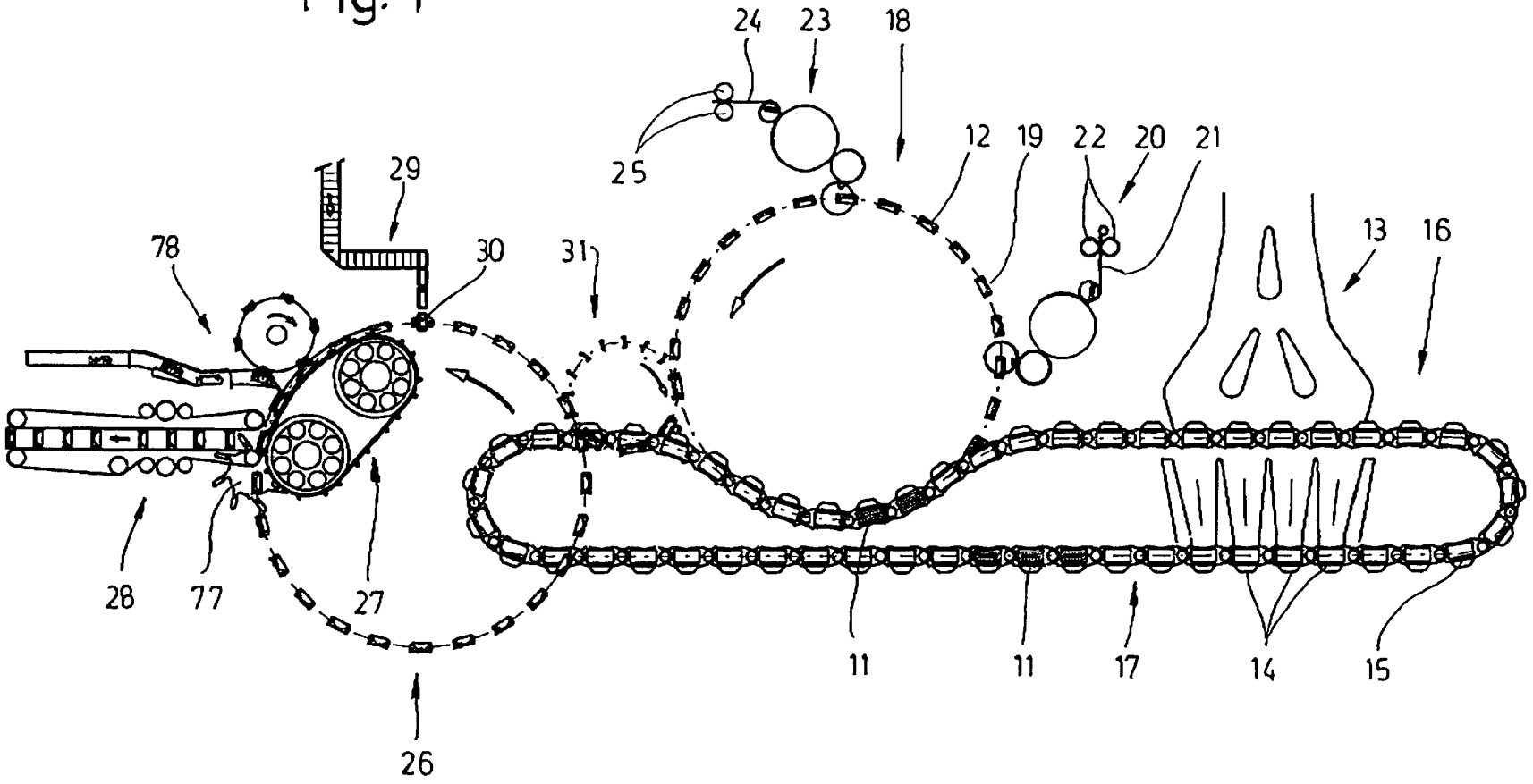
FIG. 1 shows a simplified side view of important particulars of a packaging machine for cigarettes.

The particulars illustrated in the drawings relate to a preferred example of use, namely to the manufacture of cigarette packs 10 of the soft-cup pack type. In this type of pack, the cigarette group 11 is completely surrounded by an inner blank consisting of paper or tin foil. A cigarette block 12 formed in this way is partially surrounded on the outside by an upwardly open cup consisting of paper, foil or the like.

FIG. 1 shows the basic design of a packaging machine for the manufacture of cigarette packs 10 of this type. The cigarettes are transferred to the packaging machine in the region of a cigarette magazine 13. This involves a member, conventional in packaging machines for cigarettes, for the storage of cigarettes and for dispensing cigarette groups 11 according to the content of the cigarette pack 10. For this purpose, the cigarette magazine 13 is provided, in the lower region, with magazine shafts which are combined as shaft groups 14. Cigarette group 11 is pushed out of each shaft group 14 and into pockets 15 of a pocket chain 16, specifically in the region of a lower conveying strand 17, by means of slides 32.

The pocket chain 16 transports the cigarette groups 11 to a folding turret 18, to which they are transferred by being pushed out of the pockets 15 of the pocket chain 16. Particulars of the design of the cigarette magazine 13, the pocket chain 16 and the folding turret 18 emerge from EP 226,872.

The folding turret 18 is provided with a multiplicity of folding mandrels 19 along the circumference. These serve for receiving blanks consisting of paper or tin foil for the inner wrapping and for the outer wrapping or the cup. One cigarette group 11 is kept ready inside each of the folding mandrels 19 and is pushed out or off, together with the folded blanks, in the longitudinal direction.

The folding turret is assigned members for supplying the packaging material. In the present exemplary embodiment, these are, on the one hand, an assembly for supplying blanks for the inner wrapping, that is to say a tin foil assembly 20. This corresponds expediently to the subject of DE 196 44 079.3. In this case, the blanks are detached from a material web 21. The material web is transported or advanced by means of feed rollers 22.

An assembly for supplying the outer wrapping to the folding turret 18, namely a paper assembly 23, is designed in a similar way. As regards this assembly, a material web 24 is likewise conveyed by means of feed rollers 25.

After leaving the folding turret 18, the cigarette packs 10, which are finished with the exception of an outer wrapping consisting of foil, are transferred to a drying turret 26. In this, the cigarette packs 10, the gluespots of which have not yet set, are stabilized in a relatively long period of time, with the exact paralleledpipedal shape being maintained. The drying turret is designed, for example, as evident from EP 605,838. After the formatting and consolidation of the cigarette packs 10, these are taken over from the drying turret 26 via a band conveyor 27, the particulars of which likewise emerge from EP 605,838, and are supplied to a discharge conveyor 28 for the finished cigarette packs 10.

The drying turret 26 is assigned a revenue-seal appliance 29 which transfers (revenue) seals 30 to the drying turret 26 for positioning on an end face of the cigarette pack 10. The design of the revenue-seal appliance 29 emerges from DE 196 47 670.4. The transfer of the revenue seals 30 can be inferred in detail from EP 437,201 in conjunction with EP 605,838.

Located between the folding turret 18 and the drying turret 26 is a carry-over turret 31 for taking over the cigarette packs 10 from the folding turret 18 and carrying them over to the drying turret 26. The design of the carry-over turret 31 emerges by way of example from EP 96 112 395.7.

The particular feature of the packaging machine, the design of which has been described and illustrated, is that it can be emptied for various operational reasons. For this purpose, an "emptying" programme is installed, which is initiated, for example, by actuating a corresponding switch. The "emptying" programme is coordinated with the work cycle or cycle of the entire packaging machine. As is basically known, the latter is defined in terms of the positions of the moveable members by taking into account 360° as a complete workcycle, each moveable member being assigned, at any time, a specific position which is defined in degrees of angle.

When the operating state "emptying" is initiated, the machine travels to a specific position expressed, for example, by a 20°-position. Commencing with this initial position, the working speed of the machine is reduced, for example to 50% speed. Then, as a first step, the pushing of cigarette groups 11 out of the cigarette magazine 13 is stopped. The cigarette groups 11 pushed last into pockets 15 of the pocket chain 16 are run, still complete, through the packaging machine, until the latter is completely empty.

The cigarette group 11 identified as the last cigarette group is transferred to the folding turret 18 in the way described. After the tin foil blank has been supplied in the region of the tin foil assembly 20, the latter is stopped. Consequently, no further tin foil blanks are supplied to the folding turret 18. For example, the feed rollers 22 are halted in an exact position for this purpose.

The same procedure is adopted for the paper assembly 23. When the last cigarette block 12 is provided with a paper blank, the paper assembly 23 is switched off, in particular by halting the feed rollers 25.

The cigarette packs 10 located in the region of folding turret 18 are coated with glue and ready-folded and are transferred via the carry-over turret 31 to the drying turret 26. This too is subsequently emptied. The as revenue-seal appliance 29 is switched off in the correct position.

A particular feature in terms of function and design is afforded in the region of the cigarette magazine 13 by the push-out members for the cigarette groups 11. There is a present exemplary embodiment, four shaft groups 14 are provided on the underside of the cigarette magazine 13, for simultaneously pushing out four cigarette groups 11 and pushing them into a corresponding number of pockets 15 of the pocket chain 16.

Each shaft group 14 is assigned a slide 32 for pushing out the cigarette groups 11. Four slides 32 are accordingly provided. Each slide consists of a number of webs 33 which penetrate in each case into a shaft of the shaft group 14. Each web 33 grasps two or three cigarettes located one above the other in the shaft and pushes them out.

The four slides 32 are connected in the correct position to a carrier, namely a crosspiece 34, and thus form a slide member 35. This is moved as a unit to and fro for pushing the cigarette groups 11 out of the shaft groups 14 (end position according to FIG. 4) and for return to an initial position according to FIG. 5.

The slide member 35 is connected to a carriage 36 in order to execute the rectilineal movement. The carriage is mounted displaceably on guides, namely on guide rods 37,38. The crosspiece 34 sits on the topside of the plate-shaped carriage 36.

An actuating gear 39 engages on the free rearward side of the slide member 35 or the crosspiece 34. This actuating gear consists of a drive member, namely a pivotable actuating lever 40. The actuating lever 40, mounted pivotably at a fixed location, is connected in an articulated manner to the slide member 35 via a coupling rod 41. To-and-fro pivoting movements of the actuating lever 40 therefore give rise, via the coupling rod 41, to a corresponding to-and-fro movement of the slide member 35.

The drive movements are transmitted to the actuating lever 40 by a drive lever 42. The drive lever is mounted fixedly, that is to say non-rotatably, on a shaft 43. The pivoting movements of the drive lever 42, which likewise go to-and-fro in an angular range of, for example, 30° are generated by a rotating cam mechanism, namely by a rotary-driven cam disc 44. The drive lever 42 bears with a supporting roller 45 on the outer contour of the said cam mechanism. The cam disc 44 is driven continuously in rotation via a fixedly located drive journal 46.

In this exemplary embodiment, in order to ensure that the supporting roller 45 bears constantly on the cam disc 44, the principle of a "double positive-actuation cam" is put into practice. A supporting lever 47, mounted at a predetermined angle to the drive lever 42 on the shaft 43, bears with a supporting roller 48 on the contour of a second cam disc 49. The latter is designed in such a way that the drive lever 42 together with the supporting roller 45 is always pressed reliably on to the contour of the cam disc 44 via the shaft 43.

In order to stop the slide member 35, the drive for the latter can be uncoupled from the continuously pursued drive carried out by means of the drive lever 42. In the present exemplary embodiment, the procedure is such that the actuating lever 40 is mounted freely rotatably on the shaft 43, so that, when the actuating lever 40 is stationary, the shaft 43 is nevertheless driven to-and-fro in rotation. In order to transmit movements to the slide member 35, the actuating lever 40 is connected (releaseably) to the drive lever 42.

In the present exemplary embodiment, the actuating lever 40 consists of two identical part levers 50,51 which are rotatably mounted- on the shaft 43 congruently and at an axial distance from one another. Mounted between the part levers 50,51 is a coupling member, namely a coupling segment 52. The latter is pivotably mounted on the actuating lever 40, namely between the part levers 50,51, via a rotary bearing 53. The coupling segment 52 can be pivoted by means of an actuating member, specifically by means of a pressure-medium cylinder 54. The latter is mounted at one end on the actuating lever 40 in an articulated manner. The piston rod 55 is connected to one end of the coupling segment 52 which is designed as a two-armed lever.

Figure 4:
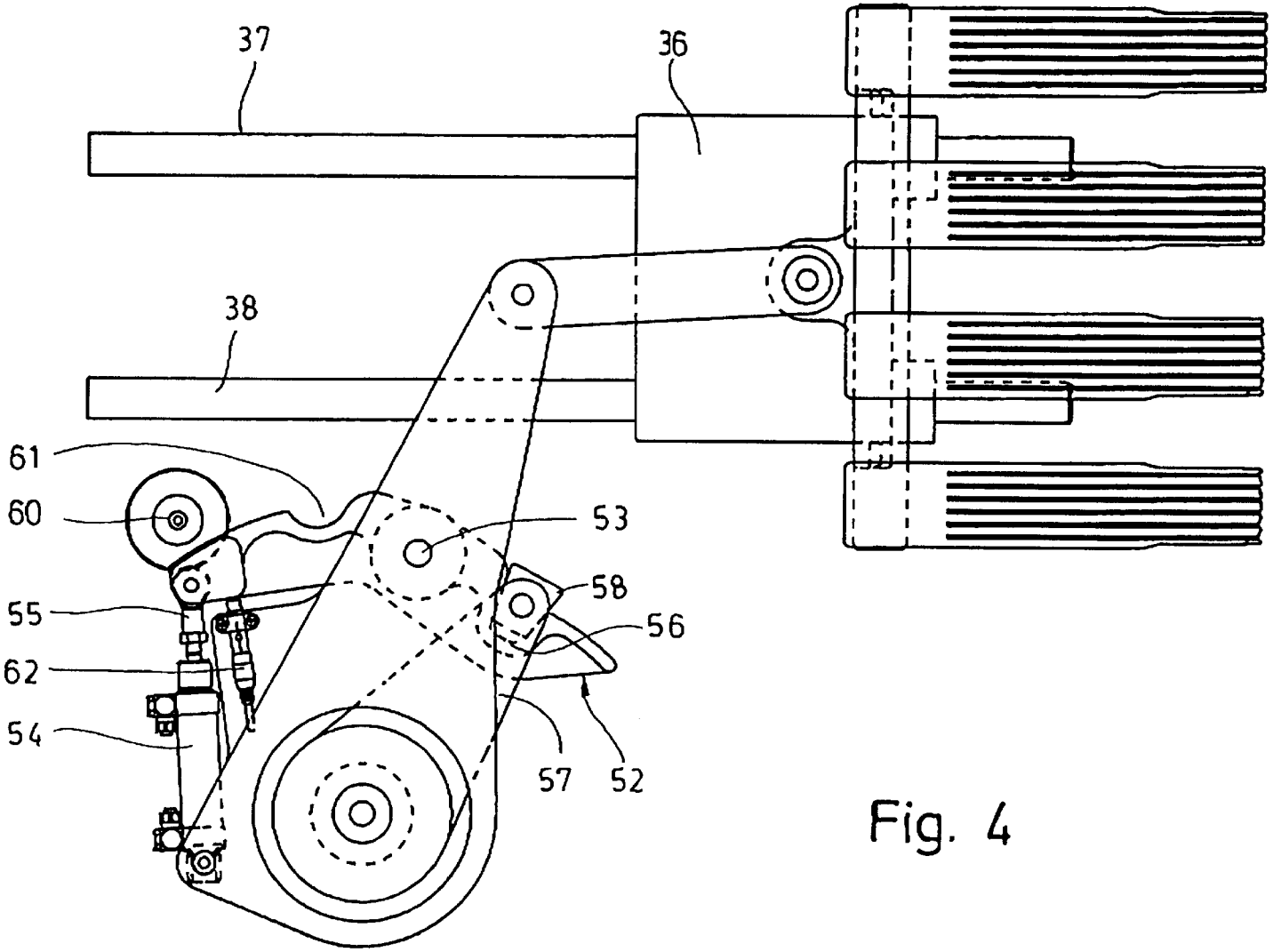
FIG. 4 shows a plan view of the unit according to FIG. 3.

The coupling segment can be moved to-and-fro by means of the actuating lever 40. In the operating position, a connecting member penetrates as a locking element into a recess or depression 56 of the coupling segment 52. The drive connection to the drive lever 42 is made by means of the locking engagement (FIG. 4).

For this purpose, a connecting lever 57 is mounted on the shaft 43, specifically non-rotatably, that is to say, rotating with the shaft 43. A locking block 58 is mounted pivotably on the free end of the connecting lever 57. The locking block is of convergent design and, in the locking position (FIG. 4), penetrates positively into the correspondingly designed depression 56 of the coupling segment 52. A fixed connection is hereby made between the drive lever 42 and the actuating lever 40, namely via the connecting lever 57 which is connected to the coupling segment 52.

In order to stop the slide member 35, the actuating lever 40 is uncoupled from the drive. For this purpose, the coupling segment 52 is pivoted in a clockwise direction (FIG. 4). The locking connection is thereby released. The locking block 58 leaves the depression 56. During the further to-and-fro movement, the locking block 58 slides along the outer contour of the coupling segment 52 outside the region of the latter (FIG. 5).

Figure 5:
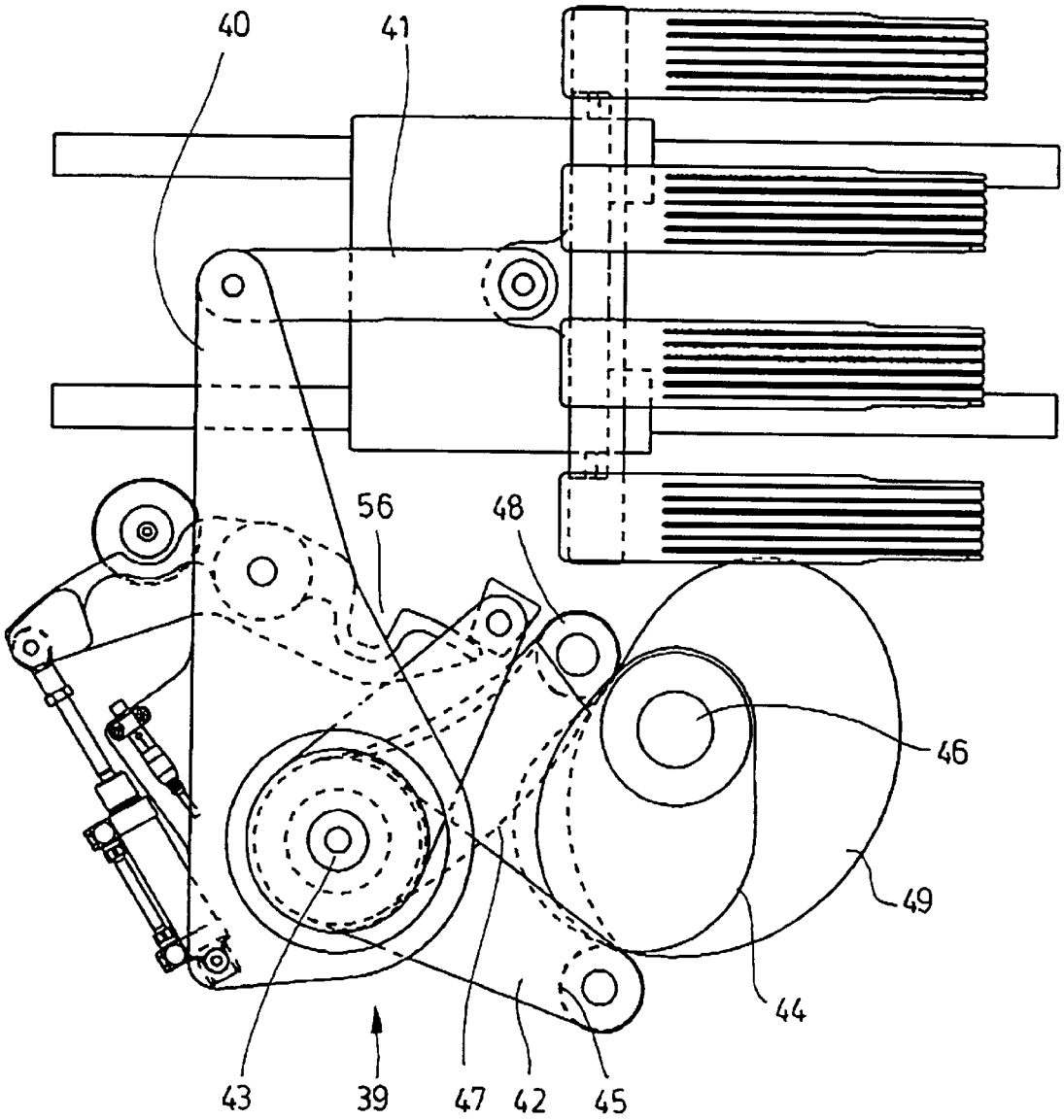
FIG. 5 shows a plan view similar to that of FIG. 4, with members being in a changed position.

The drive connection for the actuating lever 40 is made when the slides 32 are in a retracted position according to FIG. 5. In this position, a fixedly located locking member, namely a rotatable locking roller 60, is, with respect to the coupling segment 52, in a locking position, namely adjacent to a trough-shaped locking depression 61. The locking roller 60 penetrates into the latter in the clockwise direction as a consequence of the pivoting movement of the coupling segment 52 (FIG. 5) The slide member 35 is then fixed in the retracted position. In the operating position (FIG. 4), the locking roller 60 is located outside the range of movement of the coupling segment 52.

In order to ensure or monitor the operating position of the drive for the slide head 35, a contactless tracer 62 is provided, a so-called initiator. The coupling segment 52 acts on the latter in the correct operating position. If the coupling segment 52 is not in this position, the machine cannot be put into operation.

In the operating state "emptying", the slide member 35 is moved into the retracted position according to FIG. 5 when the last cigarette groups 11 have been transferred onto the pocket chain 16.

A further particular feature relates to the region of the drying turret 26.

The drying turret 26 consists of a multiplicity of axis-parallel receptacles arranged along the circumference, each for a plurality of cigarette packs 10. These receptacles are elongate shafts 63 or chambers. These are designed essentially as described in EP 605,838. As is evident from FIG. 6, each shaft 63 consists of a pack channel 64 having a U-shaped cross-section and positioned axis-parallel. The pack channel surrounds the cigarette packs 10 in a part region of the cross-section. Arranged in each case in the region of the open side, at the front in the direction of rotation of the drying turret 26, is a press-on member, namely a press-on batten 65. This comes to bear, within the pack channel 64, on a narrow sideface of the cigarette packs 10 which runs in the longitudinal direction. The dimensions of the pack channel 64 are co-ordinated with those of the cigarette packs 10, so that these are shaped within the shafts 63. The press-on battens 65 are pivotable about a rotary bearing 66. The press-on position or the relative position of the press-on batten 65 is controlled via a pivoting lever 67 which runs by means of a tracer roller 68 on a cam disc.

Figure 7:
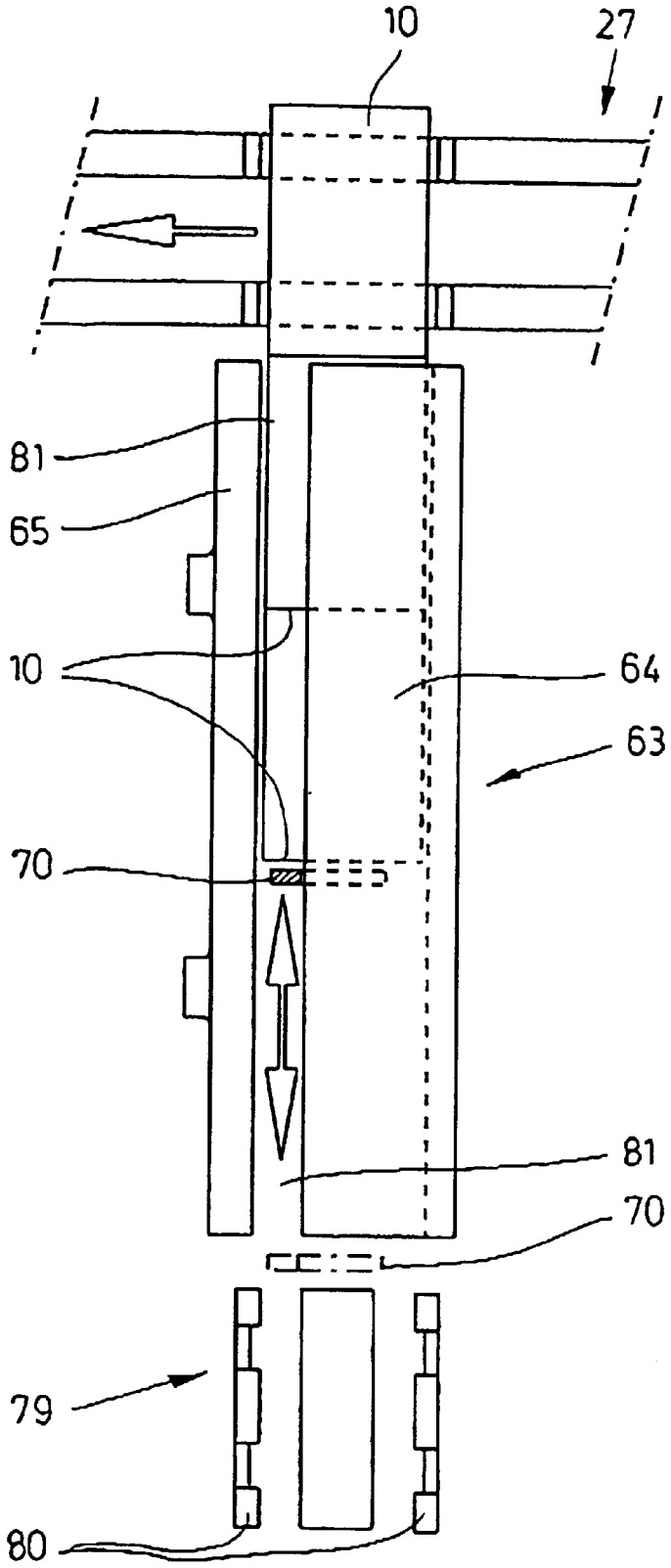
FIG. 7 shows a particular of the drying turret according to FIG. 6 in a radially directed view according to the arrow VII in FIG. 6.

The drying turret 26 is assigned a take-over turret 79 which takes over the cigarette packs 10 directly from the carry-over turret 31. In FIG. 7 this take-over turret 79 is indicated by a pocket 80 of the latter. The take-over turret 79 is an integral part of the drying turret 26 or it is connected to the latter to form a unit. The cigarette packs 10 received in the pockets 80 of the take-over turret 79 are pushed in the axis-parallel direction into the adjacent and respectively associated shafts 63.

When a cigarette pack 10 is being pushed into a shaft 63, the cigarette packs located in this shaft 63—in the present exemplary embodiment, three cigarette packs 10—are displaced a corresponding fraction further within the shaft 63 in the axis-parallel direction. In this case, a cigarette pack 10 positioned on the side opposite the push-in side leaves the shaft 63 and passes onto the band conveyor 27 which transports the finished cigarette pack 10 away.

When the packaging machine is in the emptying state, in the final phase no further cigarette packs 10 are supplied from the folding turret 18 to the drying turret 26. The cigarette packs 10 still located within the shafts 63 nevertheless have to be extracted in the way described.

For this purpose, a pushing-out member is provided, which comes into action during the operating state "emptying", specifically after the last cigarette pack 10 has been pushed into a shaft 63. A pushing-out member 69 is positioned at a fixed location outside the path of movement of the drying turret 26, specifically in the working range of the band conveyor 27. The pushing-out member 69 consists of a here U-shaped tappet 70 which penetrates with a transversely directed finger 71 into the respectively adjacent shaft 63 or into the pack channel 64 and grasps the cigarette packs 10 on the push-in side, that is to say on the rear side in the direction of movement, and displaces them by a fraction corresponding to the length of a cigarette pack 10. A cigarette pack 10 thereby emerges from the pack channel 64 on the opposite side and passes onto the band conveyor 27.

For this purpose, the tappet 70 can be displaced in the axis-parallel direction. A pressure-medium cylinder 72 is provided to this effect, specifically in the design of a cylinder without a piston rod. A laterally emerging extension 73 is connected to the tappet 70 and moves the latter a fraction in the axis-parallel direction, specifically according to the dimension of a cigarette pack 10 in the longitudinal direction of the shaft 63. In this case, the tappet 70 emerges from the shaft 63 or from the pack channel 64 in the region of the longitudinal slot 81. The longitudinal slot 81 is obtained as a consequence of the design of the shaft 63, namely as a consequence of the distance between the U-shaped pack channel 64 and the press-on batten 65.

Figure 2:
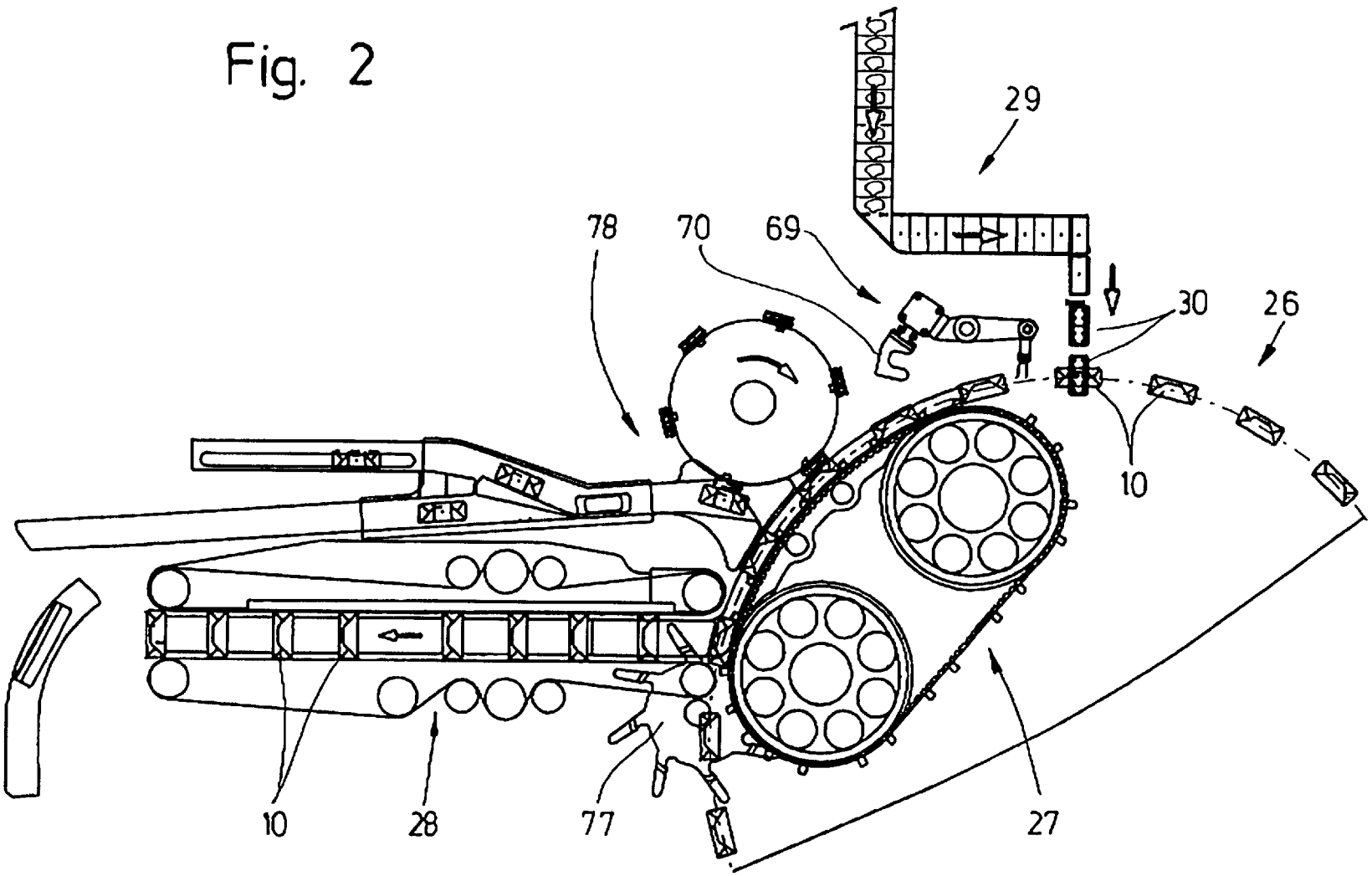
FIG. 2 shows, on an enlarged scale, a detail of the packaging machine according to FIG. 1 in the region of a drying turret.
Figure 3:
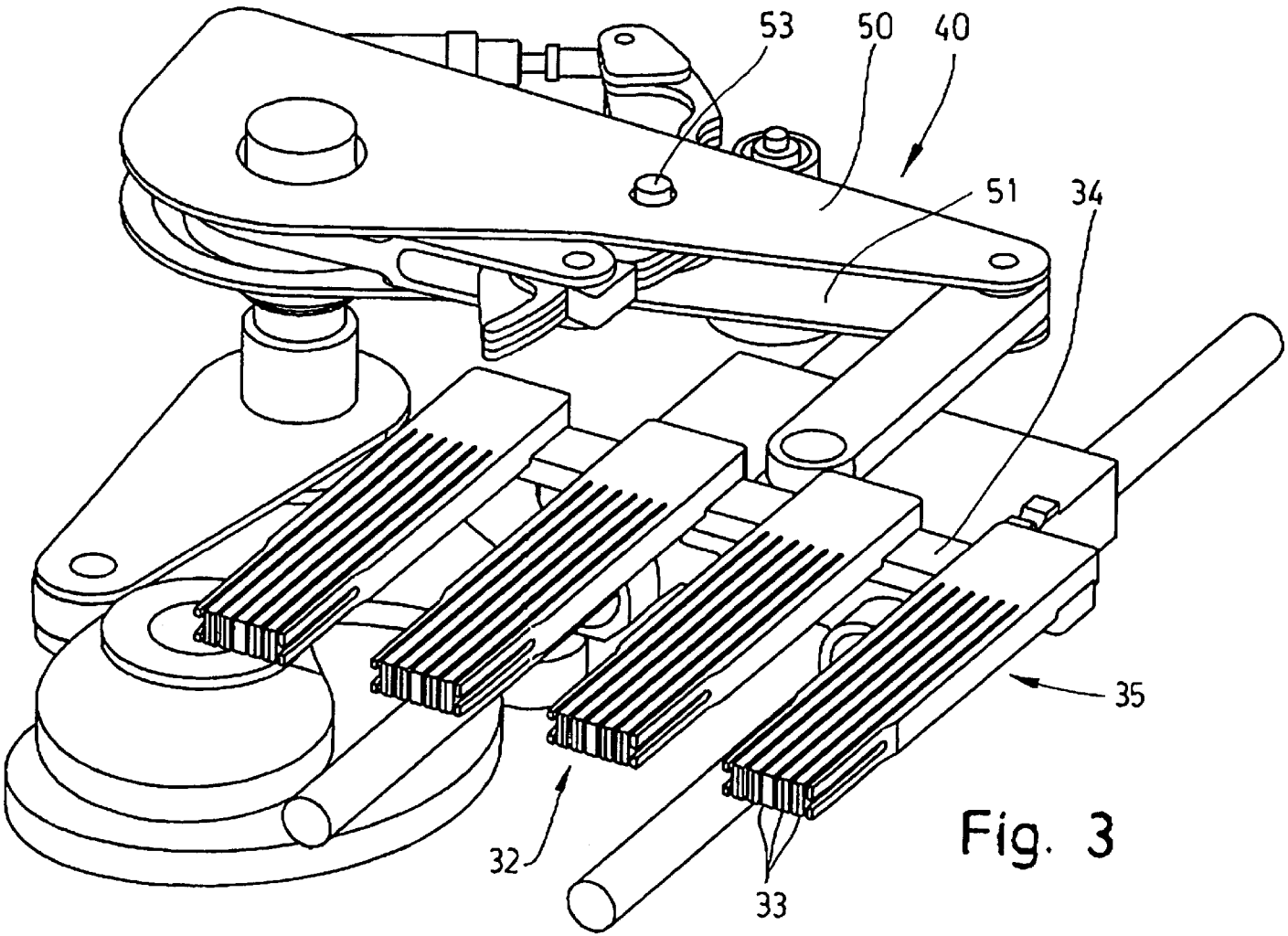
FIG. 3 shows a perspective illustration of a detail in the region of a cigarette magazine on a markedly enlarged scale.

The pushing-out member 69 or the pressure-medium cylinder 72 together with the tappet 70 can be moved into an inoperative position. For this purpose, the pressure-medium cylinder 72 is mounted pivotably on a fixedly located pivot bearing 74. A pivoting lever 75 can move the pressure-medium cylinder 72 together with the tappet 70 out of the operating position according to FIG. 6 into the stand-by position according to FIG. 2, specifically by means of an actuating cylinder 76.

Figure 6:
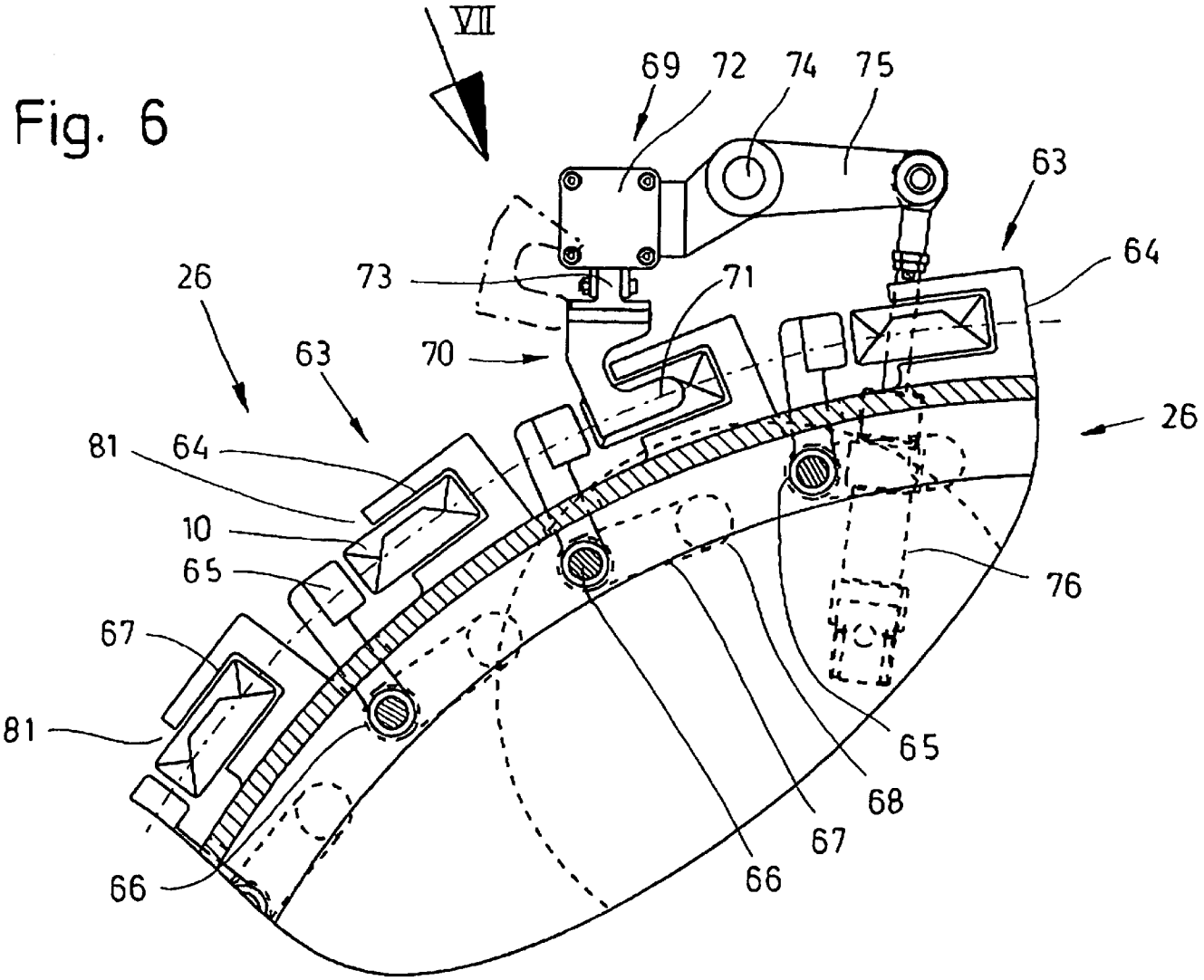
FIG. 6 shows a partially sectional sideview of a particular feature in the region of the drying turret.

On account of the work mode of the push-out member 69, the drying turret 26 is rotated intermittently during this phase, in such a way that the shafts 63 are successively moved into the pushing-out position according to FIG. 6 adjacent to the pushing-out member 69. After each pushing-out stroke, the tappet 70 is moved out of the shaft 63 or the pack channel 64, so that the drying turret 26 can be advanced by one stroke, until, finally, all the cigarette packs 10 are gradually pushed out of all of the shafts 63.

As is evident from FIG. 7, the tappet 70 is moved in a pivoting manner in one plane between the drying turret 26 and the carry-over turret 31, namely into the pushing-out position and out of this.

The pushed-out cigarette packs 10 are transferred onto a rotary-driven star wheel 77 from the band conveyor 27 which is likewise driven intermittently during this operating phase. The star wheel 77 conveys the cigarette packs 10 into the discharge conveyor 28.

When the packaging machine is restarted, a similar procedure is adopted, the moveable and described member and assemblies being switched on again in the sequence of the conveying flow of cigarette groups 11. This means that, first, in a specific position (position within 360°), the slide member 35 is put into operation again and transfers cigarette groups 11 onto the pocket chain 16. At a given time, the tin foil assembly 20 and subsequently the paper assembly 23 are put into operation again. The following members, that is to say the revenue-seal appliance 29, also take effect in the same way.

A particular feature is to be noted in the region of the drying turret 26. As described in EP 605,838, the revenue-seals 30 are positioned between the end face and bottom face of successive cigarette packs 10 in the region of the shafts 63. In the case of the cigarette packs arriving first, therefore, since it is not possible for the revenue-seal 30 to be supported on an adjacent cigarette pack 10, the first group of cigarette packs 10 is run without a revenue-seal. These cigarette packs, which are to that extent defective, are separated out in the region of the drying turrets 26 by means of an outward transfer assembly 78. The design and functioning of this outward transfer assembly 78 are described in EP 96 116 464.7. The revenue-seal appliance 29 is therefore put into operation only when the first group of cigarettes without a revenue-seal is pushed into the drying turret or into the shafts 63, so that the revenue-seals can be positioned in the region of the bottom faces of these cigarette packs.

What is claimed is:

1. A method for operating a packaging machine for the manufacture of packs (10), said packaging machine having plurality of operating components including at least one folding assembly, a store for storing pack contents, a first conveying member (16) for conveying units of pack contents, and a second conveying member (28) for conveying completely or partially finished packs (10) each containing one of said units, said method comprising the following steps wherein, in order to empty the packaging machine of the units:

said components are coordinated with one another in terms of work cycles of the machine, in such a way that, when an emptying operating state is initiated at a reduced working speed or number of work cycles of the packaging machine, a last one of the units of pack contents is identified;

said components are controlled, according to passage of units progressing through the packaging machine, in such a way that each component is switched off, according to the packaging progress after said last unit has passed said each component;

wherein the store is a cigarette magazine (13), the folding assembly is a folding turret (18), and the first conveying member comprises a pocket chain (16), and wherein, for the production of cigarette packs (10), when the emptying operating state is initiated, a slide member (35) for pushing cigarette groups (11) out of the cigarette magazine (13) into pockets (15) of a pocket chain (16) is first halted in a retracted position in a region of the cigarette magazine (13), and wherein the pockets (15) of the pocket chain (16) which are filled last determine the halting of subsequent feeding assemblies.

2. A packaging machine for the manufacture of cigarette packs (10), with at least one folding assembly (18), at least one cigarette magazine (13), a pocket chain (16) having pockets (15) for receiving cigarette groups (11), and with feeding assemblies, assigned to the folding assembly (18), for the feed of packaging material, said feeding assemblies comprising a tin foil assembly (20) and a paper assembly (23) which transfer respective blanks of the packaging material onto the folding assembly (18), wherein said machine further comprises, in order to empty the packaging machine of cigarette groups:

means for conveying a last cigarette group (11), identified at the commencement of an emptying operating state, for passage through the entire packaging machine until the last cigarette pack (10) is finished; and means for switching off the tin foil assembly (20) and paper assembly (23) in succession in response to respective passages of the last cigarette group (11);

a movable slide member (35), assigned to the cigarette magazine (13), for pushing out cigarette groups (11);

means for retaining said slide member in a retracted position outside the cigarette magazine (13);

a continuous acting drive (42) for moving the slide member (35) and coupled thereto; and for the retention of the slide member (35), means for uncoupling the slide member from the drive (42).

3. The packaging machine as claimed in claim 2, wherein the drive of the slide member (35) (42) is coupled to the slide member (35) via a moveable coupling member (52) which is gear-connected to the drive (42) by means of a locking member capable of being introduced into a depression (56) of the coupling member (52).

4. The packaging machine as claimed in claim 3, wherein the coupling member (52) is retained in a position uncoupled from the drive by means of a locking roller (60) penetrating into a locking depression (61) of the coupling member (52).

5. A packaging machine, for the manufacture of cigarette packs (10), with at least one folding assembly (18), at least one cigarette magazine (13), a pocket chain (16) having pockets (15) for receiving cigarette groups (11), and with feeding assemblies, assigned to the folding assembly (18), for the feed of packaging material, said feeding assemblies comprising a tin foil assembly (20) and a paper assembly (23) which transfer respective blanks of the packaging material onto the folding assembly (18), wherein said machine further comprises, in order to empty the packaging machine of cigarette groups:

means for conveying a last cigarette group (11), identified at the commencement of an emptying operating state, for passage through the entire packaging machine until the last cigarette pack (10) is finished;

means for switching off the tin foil assembly (20) and paper assembly (23) in succession response to respective passages of the last cigarette group (11), a drying turret (26) with pack shafts (63) for receiving a plurality of cigarette packs (10) supported on one another and for pushing a cigarette pack (10) out of a pack shaft by pushing in a newly supplied cigarette pack (10), the pack shafts (63) being emptied when the drying turret (26) is driven intermittently in rotation;

at least one pushing out member (69) for pushing a cigarette pack (10) out of a shaft (63); and in order to push a cigarette pack (10) out of the shaft (63), a tappet (70) which penetrates into the shaft (63) in an entry side thereof and displaces the cigarette packs (10) located within said shaft by a distance which corresponds at least to the dimension of a cigarette pack (10), in such away that each cigarette pack (10) is pushed out of the shaft (63) on an opposite side thereof.

6. The packaging machine as claimed in claim 5, wherein the tappet (70) penetrates with a finger (71) into the shaft (63) via an open shaft side extending in the longitudinal direction of the shaft (63).

7. A packaging machine, for the manufacture of cigarette packs (10), with at least one folding assembly (18), at least one cigarette magazine (13), a pocket chain (16) having pockets (15) for receiving cigarette groups (11), and with feeding assemblies, assigned to the folding assembly (18), for the feed of packaging material, said feeding assemblies comprising a tin foil assembly (20) and a paper assembly (23) which transfer respective blanks of the packaging material onto the folding assembly (18), wherein said machine further comprises, in order to empty the packaging machine of cigarette groups:

means for conveying a last cigarette group (11), identified at the commencement of an emptying operating state, for passage through the entire packaging machine until the last cigarette pack (10) is finished;

means for switching off the tin foil assembly (20) and paper assembly (23) in succession in response to respective passages of the last cigarette group (11);

a movable slide member (35), assigned to the cigarette magazine (13), for pushing out cigarette groups (11);

means for retaining said slide member in a retracted position outside the cigarette magazine (13), wherein the slide member (35) has a plurality of slides (32) located next to one another, each for a shaft group (14) of the cigarette magazine (13), the slides (32) being combined to form the slide member (35) and being movable to and fro as a unit with a carriage (36) on a guide;

a continuous acting drive (42) for moving the slide member (35) and coupled thereto; and for the retention of the slide member (35), means for uncoupling the slide member from the drive (42).

* * * * *